US005651541A

United States Patent [19]

Prime

[11] Patent Number: 5,651,541

[45] Date of Patent: Jul. 29, 1997

[54] MAGNETIC SHEET SEPARATOR CONSTRUCTION

[75] Inventor: Ronald M. Prime, Flint, Mich.

[73] Assignee: Atlas Technologies, Inc., Fenton, Mich.

[21] Appl. No.: 498,419

[22] Filed: Jul. 5, 1995

[51] Int. Cl.[6] ..... B65H 3/16

[52] U.S. Cl. ..... 271/18.1

[58] Field of Search ..... 271/18.1, 18.2

[56] References Cited

U.S. PATENT DOCUMENTS

| | | | |
|---|---|---|---|
| 1,716,602 | 6/1929 | Ross . | |
| 1,870,314 | 8/1932 | Lincoln . | |
| 2,474,141 | 6/1949 | Chatterton . | |
| 2,541,985 | 2/1951 | Chatterton . | |
| 2,650,092 | 8/1953 | Wall . | |
| 2,860,874 | 10/1958 | Gulick . | |
| 2,871,862 | 2/1959 | Mathiesen | 271/18.1 X |
| 4,743,006 | 5/1988 | Bolle, Jr. et al. | 271/18.1 |

FOREIGN PATENT DOCUMENTS

| | | | |
|---|---|---|---|
| 221037 | 9/1990 | Japan | 271/18.1 |
| 1331774 | 8/1987 | U.S.S.R. | 271/18.1 |

*Primary Examiner*—Boris Milef
*Attorney, Agent, or Firm*—Learman & McCulloch

[57] ABSTRACT

A magnetic separator for separating magnetically permeable, stacked sheets has permanent magnets mounted on a movable support for movements toward and away from the stack of sheets. The magnets normally occupy a position closely adjacent the stack of sheets but are movable away from such position in response to inflation of inflatable and deflatable air bag activators. Deflation of the air bag actuators enables biasing springs to return the magnets to the normal position. The rate of inflation and deflation of the actuators is controllable so as to regulate the rate of movement of the magnets.

19 Claims, 5 Drawing Sheets

40
41
1
2
34
10
14
12
13
11
17
18
20
22
21
25
29
27
31
32
9
30
28
33
37
18
26
19
24
16
20
35
4
5
8
V
P
39
38
36
9
16
20
22
19
26
21
32
6
29
25
31
9
24
14
11
10
12
13
3

40
41
42
20
10
34
12
13
22
18
28
24
23
21
9
30
32
25
19
27
5
20
16
6
4
16
23
27
22
24
18
25
32
19
9
20
34
10
7
15

MAGNETIC SHEET SEPARATOR CONSTRUCTION

This invention relates to magnetic apparatus especially adapted for use in separating magnetically permeable sheets arranged in a stack.

BACKGROUND OF THE INVENTION

It is common practice in the forming of flat, metal sheets to arrange a stack of such sheets at one end of a forming machine so as to enable the uppermost sheet of the stack to be lifted from the stack and introduced to the forming machine in which the sheet is subjected to one or more forming operations. When the confronting surfaces of the stacked sheets are smooth or have a film of lubricant thereon it sometimes is difficult to separate one sheet from another. It has been proposed, therefore, to provide a gap between the adjacent edges of the sheets at least at the uppermost end of the stack by means of a magnetic field, thereby facilitating the separation of the uppermost sheet from the remainder of the stack.

A stack of sheets conventionally is delivered to the loading end of a forming machine. If the magnetic separator is energized at the time the stack is delivered, the stack may become tilted as it approaches the source of the magnetic field. If the stack of sheets has to be removed from the loading end of the forming machine for any reason while the magnetic separator is energized, the stack also may be tilted as it moves away from the source of the magnetic field.

In some instances the magnets are so powerful that, as the stack of sheets approaches the magnets, some of the sheets are caused to separate from the stack and move rapidly and violently in the direction of the magnets, risking damage to the sheets, or to the apparatus on which the sheets are supported, or both.

The foregoing problems have been recognized in the past and overcome to some extent by the use of electromagnets which may be energized and de-energized at appropriate times. However, electromagnets are expensive, not always reliable, and require a power supply and control apparatus which is fairly short lived.

It also has been proposed to make use of permanent magnets to overcome the foregoing problems because the permanent magnets are less expensive and have a longer life. However, permanent magnets must be of considerable strength and must be movable away from the stack when the latter is introduced to the loading end of the forming machine so as to avoid displacement of some of the sheets as the stack approaches the permanent magnet. The movement of the permanent magnets heretofore has been accomplished by means of hydraulic or pneumatic cylinders which must be quite powerful, and therefore expensive, if the position of the stacked sheets is not to be changed as the magnets approach the stack powerful cylinders necessitate the use of often complex and expensive control systems, thereby adding to the cost of an installation.

A principal object of the present invention is to overcome the disadvantages associated with apparatus of the kind referred to above.

SUMMARY OF THE INVENTION

A magnetic sheet separator constructed in accordance with the invention comprises an enclosure having spaced apart front and rear walls. Accommodated in the space between the front and rear walls is a support on which a plurality of a permanent magnets are secured. The magnet support is mounted for reciprocating movements between a first position in which the magnets lie closely adjacent the front wall and a second position in which the magnets are well spaced from the front wall. Compression springs react between the rear wall of the enclosure and the magnet support and constantly urge the latter in a direction toward the front wall of the enclosure.

Secured to the magnet support is a plurality of substantially C-shaped frame members, each of which extends through an opening in the rear wall of the enclosure and has a limb which is parallel to and spaced from the magnet support. Associated with each C-shaped frame member is another C-shaped frame member that is secured to the rear wall of the housing and has a limb which is interleaved with and parallel to the limb of the first C-shaped frame member. Secured to the respective limbs are opposite ends of an inflatable and deflatable actuator which, when inflated, maintains the magnet support and the magnets thereon in a retracted position rearwardly spaced from the front wall of the closure. When the actuator is deflated, the springs are enabled to return the magnet support and the magnet to the position in which the magnets lie closely adjacent the front wall of the enclosure.

The inflatable and deflatable actuators are coupled to a source of compressed air via a valve by means of which the inflation and deflation of the actuators may be controlled.

THE DRAWINGS

Apparatus constructed in accordance with the preferred embodiment of the invention is disclosed in the accompanying drawings, wherein.

THE PREFERRED EMBODIMENT

Figure 1:
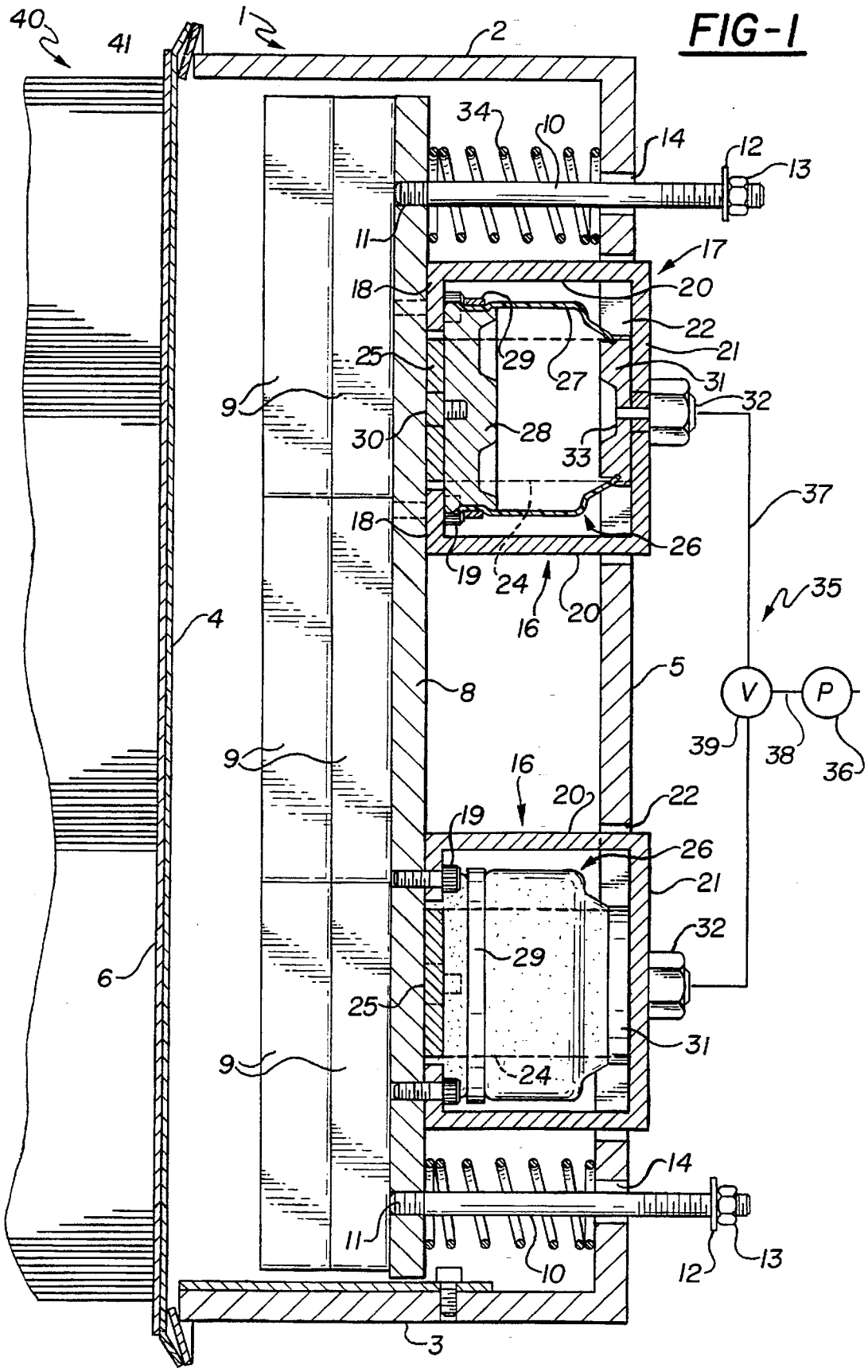
FIG. 1 is a view partly in side elevation and partly in section of the magnetic separator and illustrating the magnets in a retracted position spaced from the stack of sheets.

Apparatus constructed in accordance with the presently preferred embodiment of the invention comprises a housing or enclosure 1 having a top wall 2, a bottom wall 3, a front wall 4, and a rear wall 5. The housing may have side walls if desired and the walls preferably are non-magnetically permeable. The walls 2 and 3 are vertically spaced from one another and the walls 4 and 5 are horizontally spaced from one another. The front wall 4 is considerably thinner than the remaining walls and has secured to its outer surface one or more wear strips 6. The front wall 4 is secured to the top and bottom walls by welded connectors 7.

Within the housing is mounted a support member 8 on which a plurality of permanent magnets 9 are secured. The magnets 9 face the front wall 4 of the housing. The support member 8 is provided with a plurality of mounting studs 10 threaded at their opposite ends. Corresponding ends of the studs 10 are threaded into openings 11 formed in the member 8 whereas the opposite ends of the studs receive a washer 12 and a nut 13. Each stud extends through an opening 14 in the rear wall 5. Atop the inner surface of the lower wall 3 is a wear plate 15 on which the lower edge of the magnet mounting plate 8 bears so as to enable the plate 8 and the magnets 9 to reciprocate toward and away from the front wall 4 of the housing. In the drawings a clearance is shown between the members 8 and 15 for clarity of illustration.

Actuating means designated generally by the reference character 16 is provided to control the movements of the magnet supporting plate and the magnets. A plurality of the actuating means 16 is provided, but each is identical.

Each actuating means 16 comprises a first C-shaped frame member 17 having mounting flanges 18 secured to the rear of the mounting plate 8 by bolts 19 or the like, a pair of vertically spaced, parallel legs 20, and a vertical limb 21. The length of the legs 20 is such as to enable them to extend through an opening 22 in the rear wall 5 as is best shown in FIG. 1.

Figure 5:
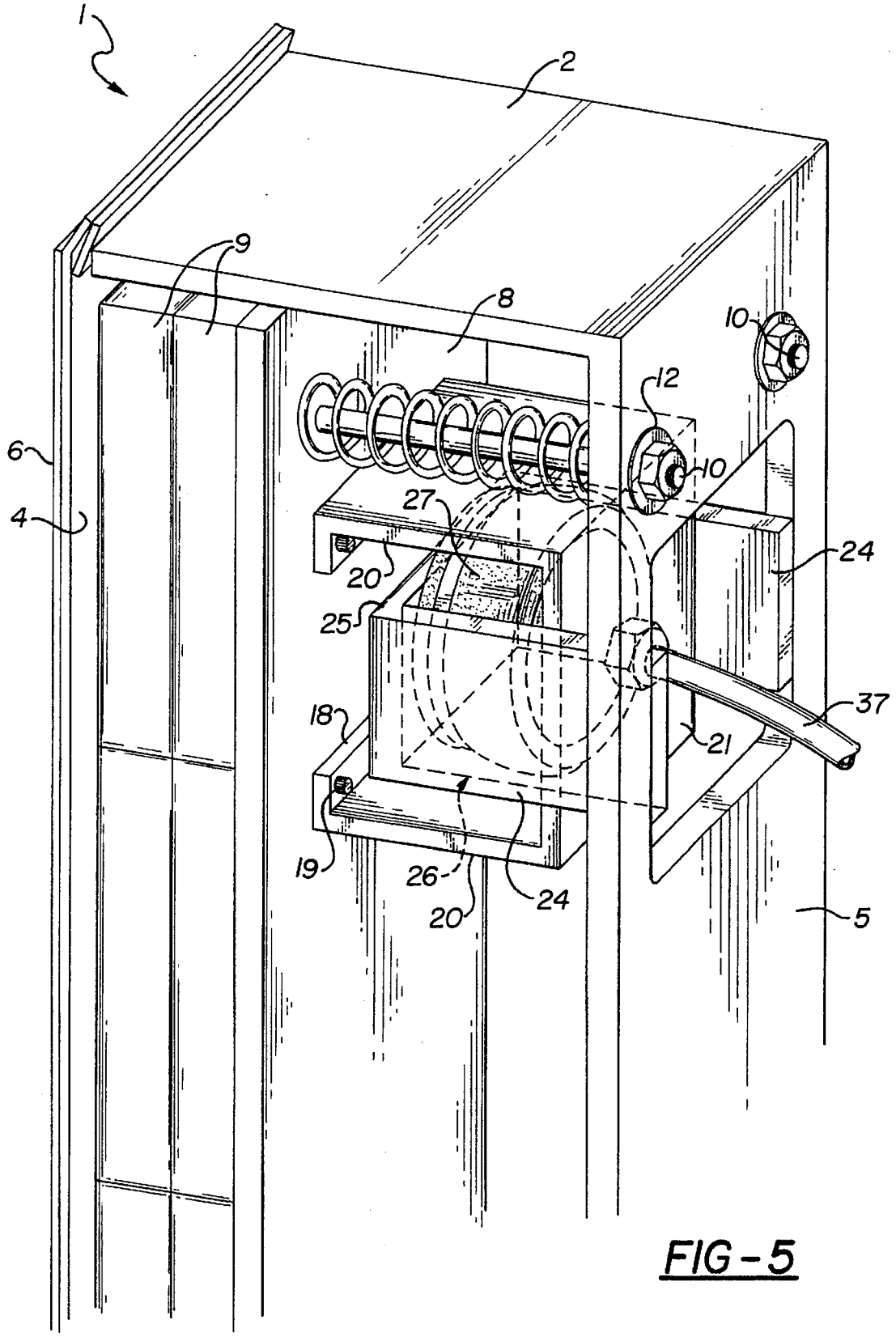
FIG. 5 is an enlarged, fragmentary, isometric view of the apparatus as shown in FIG. 2.

Each of the actuators 16 also includes a second C-shaped frame member 23 having a pair of horizontally spaced, parallel legs 24 welded or otherwise fixed at corresponding ends to the housing rear wall 5 on opposite sides of the opening 22 and joined at their opposite ends by a horizontal limb 25. As is best shown in FIG. 5, the frame members 17 and 23 are displaced from one another by 90° C. and interleaved with one another so that the respective limbs 21 and 25 confront but are spaced from one another.

Each actuator also includes an inflatable and deflatable bag 26 having a resilient, flexible, annular wall 27 secured at one end to an anchor plate 28 by means of an annular clamp 29, the plate 28 being secured to the magnet support plate 8 by means of a bolt 30. The opposite end of the annular wall 27 is secured to an anchor member 31 which has a rearwardly projecting, tubular, threaded stem 32 that extends through an opening in the limb 21. The tubular passage in the stem 32 communicates with a passage 33 in the member 31.

Encircling each of the studs 10 is a compression spring 34, one end of which seats on the magnet support 8 and the opposite end of which seats on the inner surface of the rear housing wall 5. The springs 34 constantly urge the magnet support 8 and the magnets thereon in a direction toward the front wall 4 of the housing.

Operating means designated generally by the reference character 35 is provided to effect conjoint operation of all of the actuating means 16. The operating means comprises an air compressor or pump 36 which is connected to the interior of each of the inflatable and deflatable bags 26 via the passages 33, fluid lines 37 and 38, and a valve 39. The construction and arrangement of the operating means 35 are such that, in one position of the valve 39, compressed air may be delivered into the interior of each of the airbags 26 so as to inflate such bag. Preferably, the valve 39 is one which enables the rate of inflation of the airbags to be controlled, and such valves are conventional. The valve 39 also is one which, in one position, enables the airbags 26 to be maintained inflated to any desired extent. The valve also preferably is one which enables air from each of the airbags to be exhausted at a controlled rate.

Each airbag preferably corresponds to that designated Model 1M1A by Firestone Industrial Products Company of Noblesville, Ind., and sold under the trademark AIR-STROKE.

To condition the apparatus for operation, the airbag of each actuator 16 is inflated so as to assume the configuration shown in FIG. 1. The limb 25 of the frame element 23 is immovable since its legs 24 are secured to the rear housing wall 5. Consequently, as the airbag 26 inflates, the anchor member 31 will bear against the limb 21 of the frame member 17 and move the magnet support 8 and the magnets 9 rearwardly toward the rear housing wall 5. As the support member 8 moves toward the rear wall, the springs 34 will be compressed. Accordingly, the pressure of the compressed air must be sufficient to effect not only movement of the movable parts of the apparatus, but also to overcome the compressive force of the springs 34.

Movement of the magnet support member 8 rearwardly will space the magnets 9 some distance from the front wall 4 of the housing. See FIG. 1. The force that a permanent magnet may exert on a magnetically permeable object is inversely proportional to the distance between the magnet and such object. The distance that the magnets are spaced from the front wall 4 should be sufficient to enable a stack 40 of magnetically permeable sheets 41 to be moved into engagement with the wear strips 6 of the front wall 4 without being accelerated into engagement with the housing by the magnetic force exerted on the stack of sheets by the magnets. This is the position of the magnets 9 as illustrated in FIG. 1.

Figure 2:
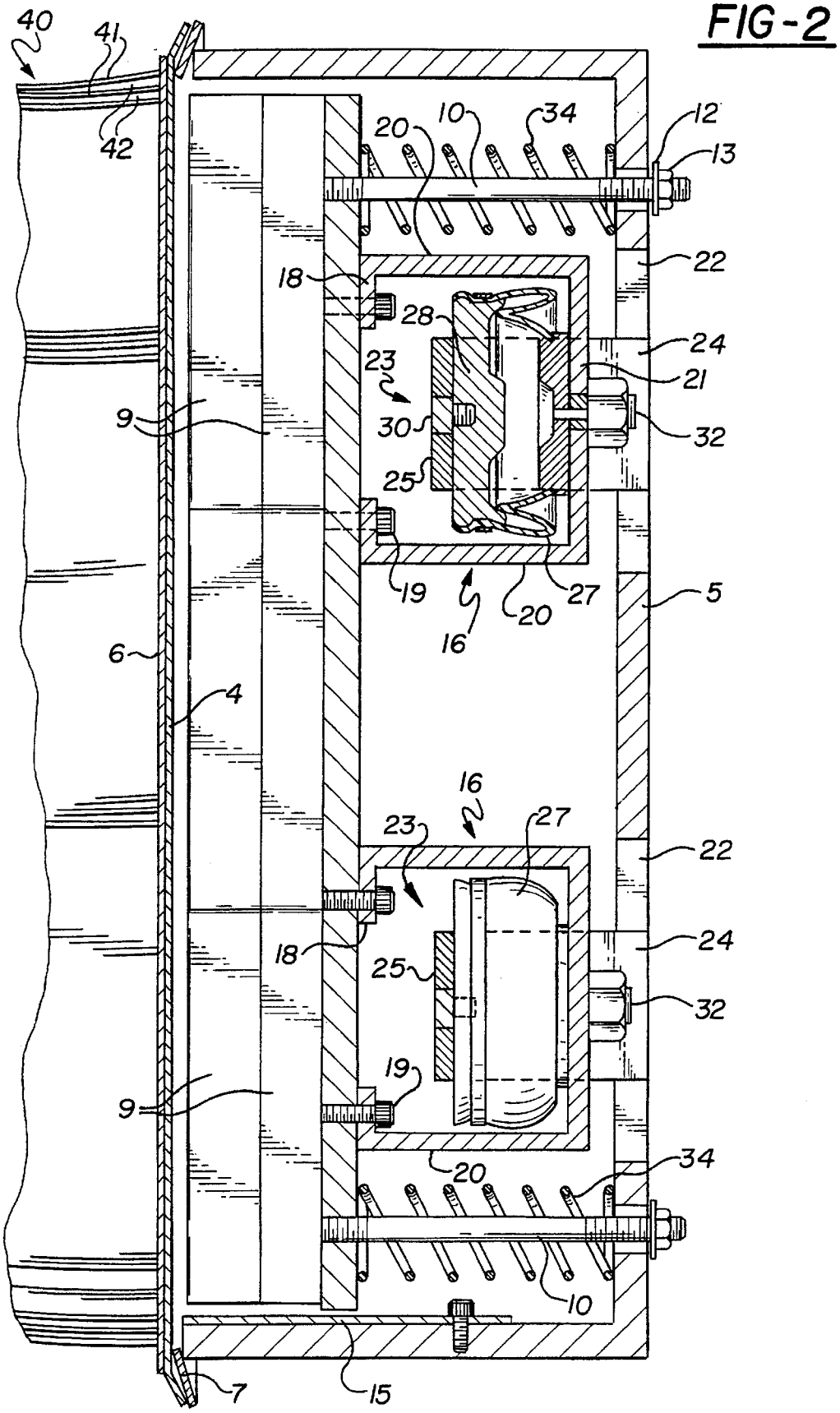
FIG. 2 is a view similar to FIG. 1 but illustrating the magnets in a projected position in which they lie closely adjacent the stack of sheets.
Figure 3:
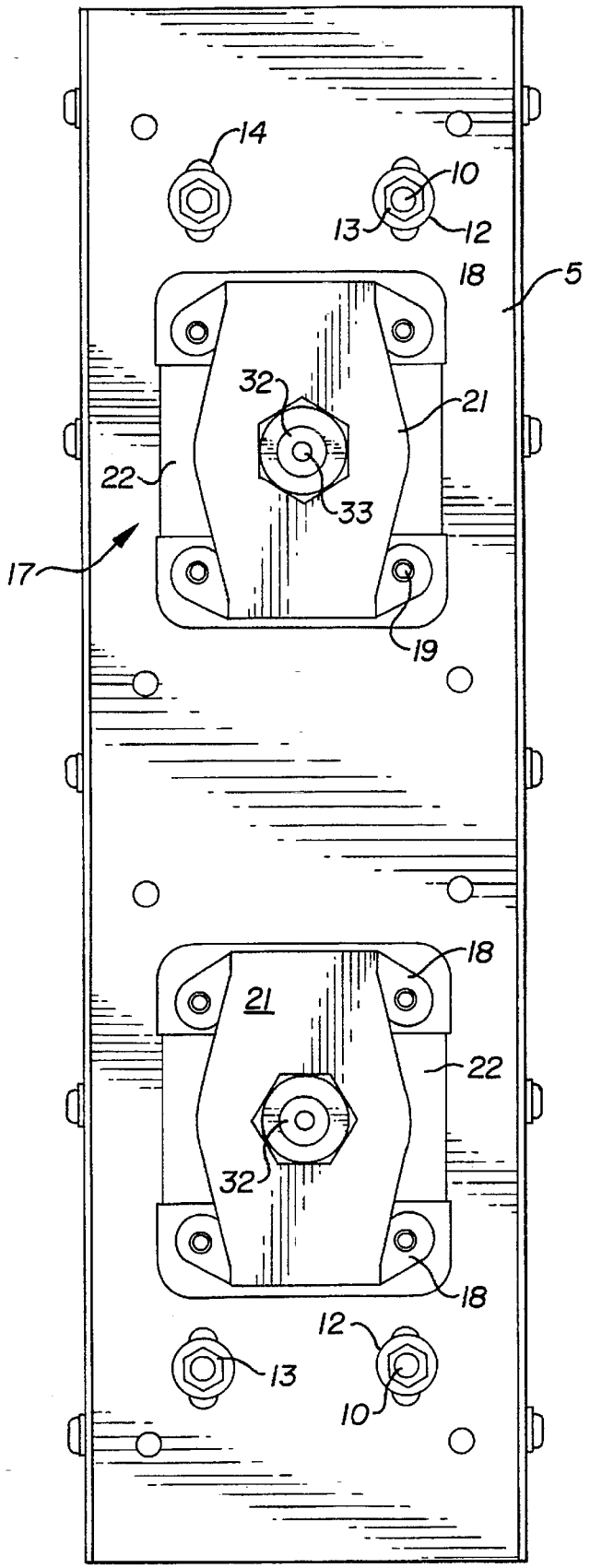
FIG. 3 is a rear elevational view.
Figure 4:
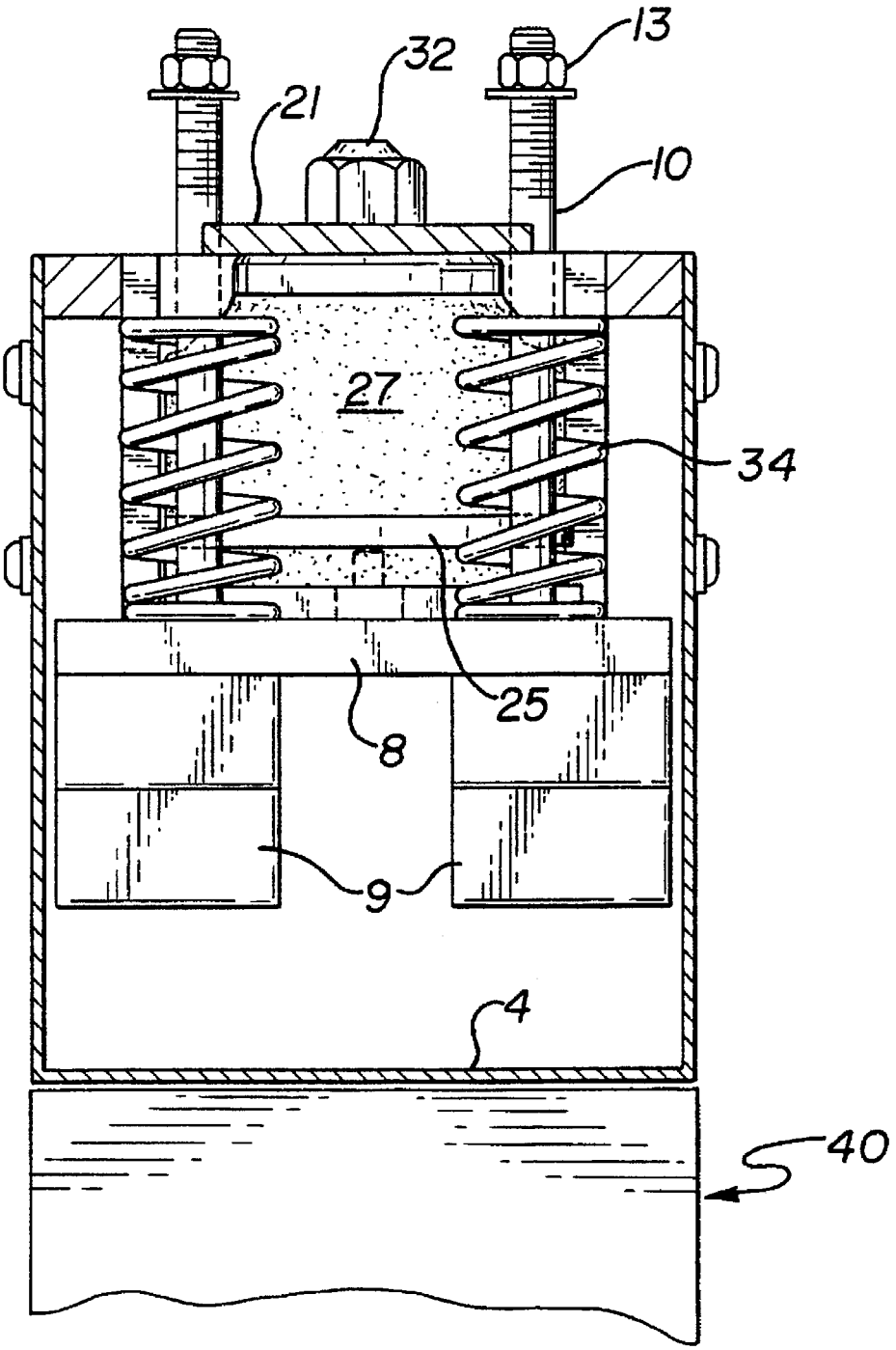
FIG. 4 is a view partly in top plan and partly in section.

When the stack of sheets 41 has been placed in position at the front wall of the housing, the valve 39 may be adjusted so as to enable air to be exhausted from the inflated airbags at a controlled rate depending upon the position of the valve 39. Once the valve has been adjusted to enable the exhaust of air from the airbags, the springs 34 will expand and move the magnet support 8 and the magnets toward the front wall of the housing at a rate determined by the setting of the valve 39. The extent of forward movement of the magnets is controlled by the position of the washer and nuts on the studs 10, and such position is variable by adjustment of the nuts. When the airbags are fully deflated, the parts of the apparatus will be in the positions shown in FIGS. 2 and 5, thereby enabling the magnetic flux to provide a gap 52 between adjacent sheets in the stack 40.

Since the magnets 9 will be withdrawn from a position adjacent the front wall 4 only in response to inflation of the actuators 16, any failure of the pump or leakage of the airbags 26 will result in the magnets being located adjacent the front wall.

The disclosed embodiment is representative of a presently preferred form of the invention, but is intended to be illustrative rather than definitive thereof. The invention is defined in the claims.

What is claimed is:

1. A magnetic sheet separator construction for providing a gap between adjacent, magnetically permeable sheets arranged in a stack, said construction comprising magnet support means; at least one magnet carried by said support means; means mounting said support means for movements between first and second positions in which said magnet respectively is adjacent and spaced from said stack; biasing means acting on said support means and constantly exerting a force on said support means urging the latter toward one of said positions; pressure fluid actuating means operable to overcome the force of said biasing means and move said support means toward the other of said positions; and means for operating said actuating means.

2. The construction according to claim 1 wherein said biasing means comprises at least one spring.

3. The construction according to claim 1 wherein said actuating means comprises at least one inflatable and deflatable bag.

4. The construction according to claim 1 wherein said one of said positions is said first position.

5. The construction according to claim 1 wherein said other of said positions is said second position.

6. The construction according to claim 1 wherein said pressure fluid is a gas.

7. The construction according to claim 1 wherein said magnet is a permanent magnet.

8. A magnetic sheet separator construction for providing a gap between adjacent, magnetically permeable sheets arranged in a stack, said construction comprising a housing having a front wall against which said stack of sheets may bear; magnet support means; at least one permanent magnet carried by said support means; means mounting said support means for reciprocating movements between first and second positions in which said magnet respectively is adjacent and spaced from said wall; spring means acting on said support means and constantly urging the latter toward one of said positions; inflatable and deflatable actuating means acting on said support means and operable when inflated to overcome said spring means and move said support means from said one of said positions to the other of said positions, said actuating means when deflated being incapable of overcoming said spring means; and operating means for inflating and deflating said actuating means.

9. The construction according to claim 8 wherein said one position is said first position and said other position is said second position.

10. The construction according to claim 8 wherein said actuating means comprises an inflatable and deflatable airtight bag having resilient, flexible walls.

11. The construction according to claim 8 wherein said housing has a rear wall spaced from said front wall and wherein said support means and said magnet are accommodated in the space between said front and rear walls, and wherein said actuating means reacts between said support means and said rear wall.

12. The construction according to claim 11 wherein said spring means reacts between said support means and said rear wall.

13. The construction according to claim 11 wherein said actuating means is mounted on a first frame member fixed to said rear wall and reacts on a second frame member fixed to said support means.

14. The construction according to claim 13 wherein said first and second frame members have overlying, spaced apart limbs between which said actuating means is accommodated.

15. The construction according to claim 8 including means for adjusting the position of said support means relative to said front wall.

16. A magnetic sheet separator construction for providing a gap between adjacent, magnetically permeable sheets arranged in a stack, said construction comprising an enclosure having a front wall against which said sheets may bear and a rear wall spaced from said front wall; magnet support means; at least one permanent magnet fixed to said support means; means mounting said support means for reciprocating movements between said front and rear walls from a first position in which said magnet is adjacent said front wall to a second position in which said magnet is spaced from said front wall; spring means reacting between said rear wall and said support means and constantly urging said support means toward said first position; a first frame member secured to said support means; a second frame member secured to said rear wall and interleaved with said first frame member to provide a pair of confronting, spaced apart limbs; an inflatable and deflatable actuating member interposed between and bearing on each of said limbs; and operating means for inflating and deflating said actuating means, inflation of said actuating means enabling the latter to overcome said spring means and effect movement of said support means from said first position toward said second position, and deflation of said actuating means enabling said spring means to return said support means to said first position.

17. The construction according to claim 16 wherein said mounting means is adjustable to enable said first position of said support means to be varied relative to said front wall.

18. The construction according to claim 16 wherein said first frame member has a pair of substantially parallel legs extending toward and secured to said support means and said second frame member has a pair of substantially parallel legs extending toward and secured to said rear wall, the parallel legs of said first member and the parallel legs of said second member being 90° C. displaced from one another.

19. The construction according to claim 16 wherein said operating means is adjustable to vary the rate of inflation and deflation of said actuating means and consequently the rate of movement of said magnet support means.

* * * * *